United States Patent [19]

Bernasconi et al.

[11] Patent Number: 4,755,819

[45] Date of Patent: Jul. 5, 1988

[54] REFLECTOR ANTENNA AND METHOD OF FABRICATION

[75] Inventors: Marco C. Bernasconi; Karl Kotacka, both of Zürich, Switzerland

[73] Assignee: Contraves AG, Zürich, Switzerland

[21] Appl. No.: 859,377

[22] Filed: May 5, 1986

[30] Foreign Application Priority Data

May 15, 1985 [CH] Switzerland ..... 2077/85

[51] Int. Cl.[4] ..... H01Q 1/28

[52] U.S. Cl. ..... 343/915

[58] Field of Search ..... 343/DIG. 2, 709, 912, 343/915

[56] References Cited

U.S. PATENT DOCUMENTS

| | | | |
|---|---|---|---|
| 2,996,212 | 8/1961 | O'Sullivan | 220/1 R |
| 3,224,000 | 12/1965 | Bloetscher et al. | 342/10 |
| 3,282,533 | 11/1966 | Spain | 244/158 R |
| 3,354,458 | 11/1967 | Rottmayer | 342/10 |
| 3,391,882 | 7/1968 | Johnson et al. | 244/158 R |
| 3,916,418 | 10/1975 | Erdmann et al. | 343/912 |
| 4,191,604 | 3/1980 | MacTurk | 343/912 |
| 4,364,053 | 12/1982 | Hotine | 343/915 |
| 4,475,109 | 10/1984 | Dumas et al. | 343/709 |
| 4,550,319 | 10/1985 | Ganssle eet al. | 343/DIG. 2 |

FOREIGN PATENT DOCUMENTS

| | | | |
|---|---|---|---|
| 0097205 | 6/1984 | Japan | 343/DIG. 2 |

OTHER PUBLICATIONS

"Antennas for Space Communication-Deployable Paraboloids", NASA Contractor Report No. NASA CR-1688, published Feb., 1971.

*Primary Examiner*—William L. Sikes
*Assistant Examiner*—Doris J. Johnson
*Attorney, Agent, or Firm*—Werner W. Kleeman

[57] ABSTRACT

A parabolically-shaped reflector antenna particularly intended for space vehicle applications, can be transported into outer space in a folded state. There it is inflated by means of a gaseous agent, such as a gas compound or gaseous medium, which is transported with the space vehicle. The antenna reflector and an antenna radome form an inflatable cavity which is stabilized by a rigidizing torus. The covering material of the antenna reflector, the antenna radome and the rigidizing torus comprise a resin-impregnated layer of fabric. After inflation in outer space, the reflector antenna is aligned such that it will be substantially uniformly heated by the sun for substantially uniform polymerization of the resin impregnant. After polymerization, the reflector antenna requires no gas pressure to keep its shape.

18 Claims, 3 Drawing Sheets

REFLECTOR ANTENNA AND METHOD OF FABRICATION

BACKGROUND OF THE INVENTION

The present invention relates to a new and improved construction of a reflector antenna for applications in outer space and to a method of fabricating such reflector antenna.

In its more particular aspects, the present invention relates not only to the reflector antenna itself, but also to an improved method for constructing and deploying the reflector antenna. The reflector antenna specifically comprises a parabolically-shaped reflector antenna comprising an unfolding or deployable laminated-surface structure, an inflatable radome which forms a shroud-like body structure, an antenna reflector and a rigidizing member or annulus, such as a torus or toroidal support member.

The reflector antenna fabrication method of the present invention aims at providing a reflector antenna construction whose reflector forms together with a radome a cavity, stabilized by means of a tubular rigidizable torus.

In other words, the method aspects of the present invention relate to a method for fabricating an inflatable reflector antenna for deployment in outer space and comprises the steps of fabricating an antenna reflector, an antenna radome and a stabilizing annulus from a textile laminate, wherein the textile laminate for at least the antenna reflector and the antenna radome is a textile laminate impregnated with a setting component. The textile laminate for the antenna radome more specifically is a textile laminate transparent to at least a portion of the electromagnetic spectrum of radiant energy. Moreover, a material layer reflective of at least such portion of the electromagnetic spectrum of radiant energy is applied to an inner side of the antenna reflector.

The method of the present invention for deploying a reflector antenna in outer space comprises the steps of transporting beyond the atmosphere an antenna package comprising an antenna feed mast and an inflatable envelope made of a textile laminate and wrapped around the antenna feed mast in a series of folded pleats ready for deployment, wherein the inflatable envelope comprises an antenna reflector, an antenna radome and a stabilizing annulus, and the textile laminate is impregnated with a setting component, such as a setting resin for at least the antenna reflector and the antenna radome.

The reflector antenna of the present invention is for deployment in outer space and comprises an antenna feed mast having a first end provided with an interface socket for attachment to a transport vehicle and a second end remote from the first end and provided with a feed head for the reflector antenna. The reflector antenna further comprises an antenna reflector, an antenna radome and a stabilizing annulus conjointly defining an inflatable envelope. The inflatable envelope has an initial folded state in which the inflatable envelope is wrapped around the antenna feed mast to form a compact antenna package for transport into outer space and a terminal deployed state in which the inflatable envelope is inflated to form a desired spatial configuration of the reflector antenna defining a focal point of the antenna reflector and in which the feed head is at the focal point.

For reflector antennas of the aforementioned construction, e.g., for applications in outer space, there exist additional stringent requirements, such as precise dimensional stability and accuracy of the antenna structure in addition to special requirements which are imposed by transport conditions to an orbit in space vehicles, i.e., minimum weight and compactly folded packaged condition.

In common practice, antennas for applications in outer space are of mechanical construction, comprising ribs and/or panels with numerous individual components, such as hinges, supports, springs, tie ropes, brake systems for controlled deployment and many more. This involves intricate construction schemes and furthermore, due to the large number of individual components, requires compromises between reflector dimensional accuracy and/or reliability.

Problems involving such mechanically unfoldable antennas are further described in an article by W. Schäfer:

Stand der Technik auf dem Gebiet grösserer, entfaltbarer Parabolantennen-Strukturen für Raumfluggeräte (cf. Flugwissenschaftliche Weltraumforschung Apr. 4, 1980, No. 5).

There has long been known in the art a gas pressure deployable and stabilizable, i.e., inflatable, parabolic antenna construction displaying relatively low weight and low storage volume, together with large operating diameter and especially high dimensional reflector accuracy (cf. American Institute of Aeronautics and Astronautics, January, 1980). Such an antenna, however, is endangered by meteorites, thus exhibiting a short life expectancy and requiring the transport of gas supplies for replenishing and maintaining gas pressure within the antenna cavity, i.e., to replace losses of gas caused by meteorite punctures and leaks along the seams.

SUMMARY OF THE INVENTION

Therefore, with the foregoing in mind, it is a primary object of the present invention to provide a new and improved construction of an inflatable reflector antenna for application in outer space which does not exhibit the aforementioned drawbacks and shortcomings of the prior art constructions.

It is a further specific object of the present invention to provide a new and improved construction of an inflatable reflector antenna and method of fabricating the same, which, in addition to the basic advantages of inflatability, exhibits improved structural stability and considerably extended life expectancy.

Another specific object of the present invention aims at providing a new and improved construction of an unfoldable, laminated-surface reflector antenna and, more particularly, a parabolically-shaped reflector antenna, comprising a shroud-like inflatable body, forming a radome, an antenna reflector and a rigidizing member, such as a torus as well as polymerizing materials for at least a portion of the components constituted by the radome and antenna reflector.

It is a still further object of the present invention to provide a new and improved construction of an inflatable reflector antenna for application in outer space and method of fabricating the same, which exhibits relatively low weight, together with compactly folded packaging capability, while possessing a large operational diameter.

It is a further significant object of the present invention to provide a new and improved construction of a reflector antenna for application in outer space which exhibits long service life and does not require a gas supply source for maintaining the antenna operational.

It is still another further significant object of the present invention to position the reflector antenna so as to face the sun, to provide polymerization by influence of the sun's rays alone or by the additional influence of a catalyzing gas which is a gas compound used to inflate and shape the reflector antenna.

In order to implement these objects and still others which will become more apparent as the description proceeds, the reflector antenna of the present invention is manifested by the features that the unfoldable laminated shroud-like surface structure at least partially comprises a polymerizing material for polymerizing during the inflation process.

The method of the present invention for fabricating an inflatable reflector antenna for deployment in outer space is manifested by the features that the step of fabricating the antenna reflector, the antenna radome and the stabilizing annulus entails fabricating the antenna reflector such that the antenna reflector defines a focal point as well as by the further method steps of assembling the antenna reflector, the antenna radome and the stabilizing annulus to form an inflatable envelope defining the reflector antenna and an internal cavity or void thereof, mounting the inflatable envelope to an interface socket of an antenna feed mast such that a feed head of the antenna feed mast is at the focal point of the antenna reflector, providing the internal cavity or void and the stabilizing annulus with conduit means for introducing a pressurized gaseous agent and wrapping the inflatable envelope around the antenna feed mast in a series of folded pleats for forming a compact package ready for deployment in outer space by inflation with the pressurized gaseous agent.

The method of the present invention for deploying a reflector antenna in outer space is manifested by the features that it comprises the further steps of inflating the inflatable envelope to impart thereto a desired spatial configuration of the reflector antenna and inflating the stabilizing annulus of the inflatable envelope for stabilizing the desired spatial configuration and causing the setting component to set. Setting can be accomplished either by orienting the inflated reflector antenna toward the sun for exposing the setting component to solar energy until the setting component has set or using as the gaseous agent a gaseous compound containing a catalyzor gas.

Furthermore, the reflector antenna of the present invention for deployment in outer space is additionally manifested by the features that at least the antenna reflector and the antenna radome comprise a textile laminate impregnated with a setting component. The antenna reflector is coated on at least one side with a material reflective of at least a portion of the electromagnetic spectrum of radiant energy. The antenna radome specifically comprises a textile laminate transparent to at least such portion of the electromagnetic spectrum. The inflatable envelope defines a first internal cavity or void and the stabilizing annulus defines a second internal cavity or void. Flexible conduit means operatively connect the first and second internal cavities or voids with the interface socket for introducing a pressurized gaseous agent from the transport vehicle into the first and second internal cavities or voids for inflating the inflatable envelope into the terminal deployed state and maintaining the desired spatial configuration of the reflector antenna until the setting component has set.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various Figures of the drawings there have been generally used the same reference characters to denote the same or analogus components and wherein.

DETAILED DESCRIPTION OF THE PREFERRED EMBODIMENTS

Figure 1:
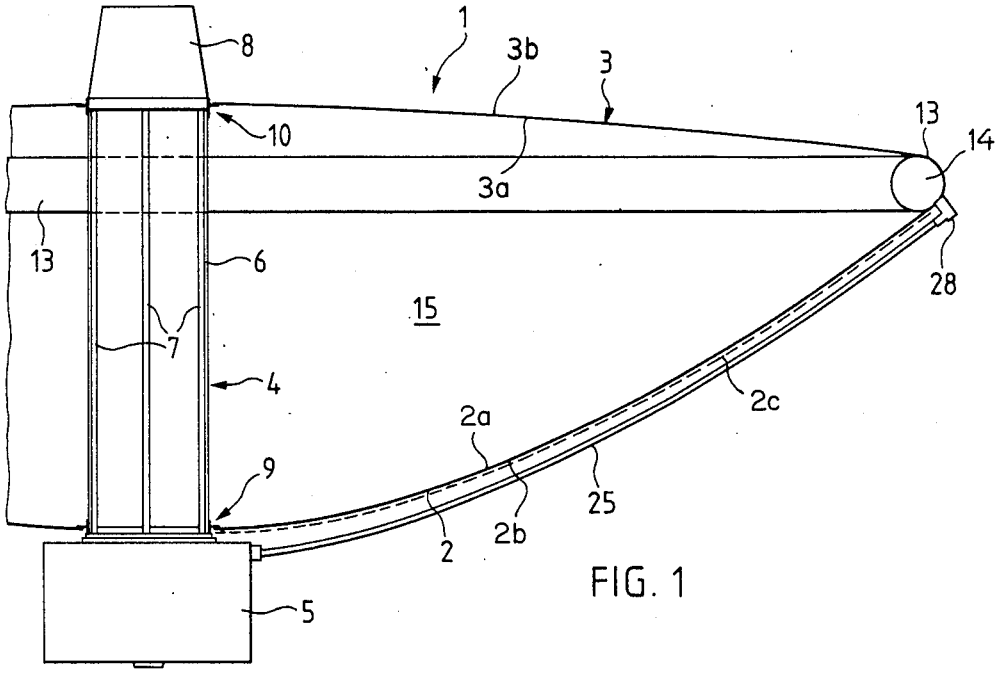
FIG. 1 shows a partial fragmentary cross-section of a parabolic reflector antenna in a simplified depiction.

Describing now the drawings, it is to be understood that to simplify the showing thereof, only enough of the structure of the reflector antenna has been illustrated therein as is needed to enable one skilled in the art to readily understand the underlying principles and concepts of the present invention. Turning now specifically to FIG. 1 of the drawings, the reflector antenna 1 illustrated therein by way of example and not limitation will be seen to comprise an antenna tower or feed mast 4, circularly surrounded by an antenna reflector 2 and a protective cover or antenna radome 3. The antenna tower or feed mast 4 is arranged at a focus or focal point defined by the preferably essentially parabolic antenna reflector 2. This antenna tower or feed mast 4 comprises essentially an interface socket component or member 5 to which there are affixed in a distributed arrangement along the circumference several rods 7 which are wrapped by a foil 6 and determine the length of the antenna tower or feed mast 4. The antenna tower or feed mast 4 furthermore comprises a feed or infeed head 8. A sub-reflector or secondary reflector can be arranged in place of the feed head 8. The interface socket component or member 5 permits mechanical and fluid as well as electrical connection to a space vehicle which is not particularly illustrated.

Figure 4:
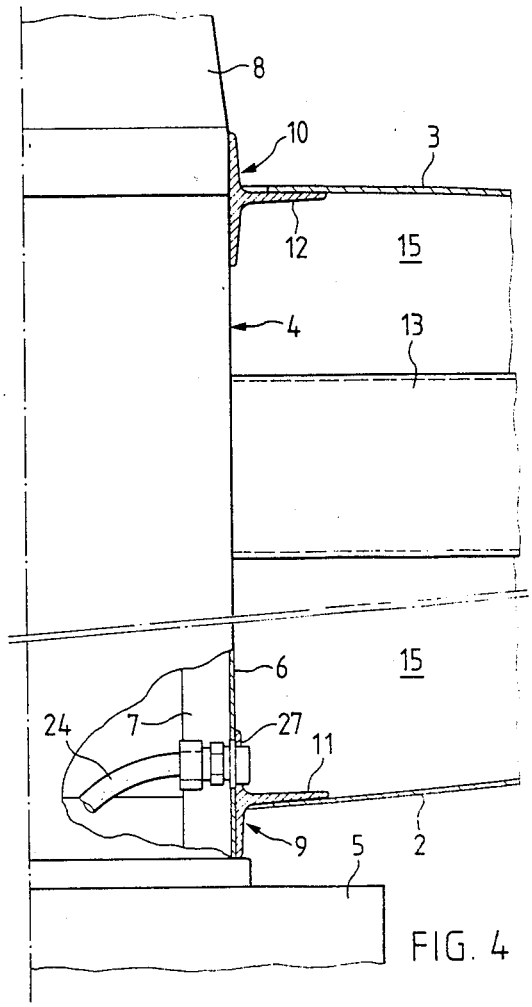
FIG. 4 shows an enlarged partial cross-section of a central area of the reflector antenna according to FIGS. 1, 2 and 3.

As depicted in more detail in FIG. 4, there is located within the area of the interface socket component or member 5 and the feed head 8 the antenna tower or feed mast 4, surrounded by a fastening ring 9 and a fastening ring 10, each comprising a respective flange 11 and 12 protruding towards the exterior and serving to respectively carry the antenna reflector 2 and the antenna radome 3 which are affixed to the associated flange 11 and 12 (e.g. by means of bonding). Along the outer circumference, the antenna reflector 2 and the radome 3 are interconnected by means of a substantially tubular external or peripheral rigidizing or reinforcing annulus, such as an annulus or torus 13, which together with the dimensioning of the surface of the reflector 2 and the radome 3 determine the form taken by the reflector antenna 1 under the influence of internal gas pressure. In the example depicted herein, the antenna radome 3 has a considerably shallower parabolic curvature than the antenna reflector 2, so that the fastening ring 10 for the radome 3 can move into the desired position relative to the feed head 8. The antenna radome 3 can also be formed symmetrically with respect to the shape of the antenna reflector 2, i.e., possessing the same but inverse curvature, as can be seen in the example of an offset parabolic reflector antenna 1 depicted in FIG. 6.

The antenna reflector 2, the antenna radome 3 and the external cover of the rigidizing annulus or torus 13 consist of a rigid surface configuration derived from a setting process such as a polymerization process which, in the preferred embodiment, includes a pigmented laminate for controlling the absorption of radiant energy, especially solar radiation. The component making possible setting, such as polymerization can, e.g., be a setting resin such as a polymerizing resin-impregnated fabric layer applied to the inside curvatures of the reflector 2 and the radome 3, and respectively generally indicated by reference characters 2*a* and 3*a*. For setting as by polymerization, the resin is brought into contact with a gaseous agent, such as a gaseous compound, supplied through an antenna cavity or first void 15 by means of a supply means or line or conduit 24 and to the second void 14 of the external rigidizing annulus or torus 13 by means of a further supply means or line or conduit 25. The gaseous agent used for inflating the reflector antenna 1 may particularly comprise a catalyzor gas or catalyzing gas or agent. The fabric layer 2*a*, 3*a* makes external contact with a laminated plastic foil 2*b*, 3*b* which serves as a gas leak inhibitor during the inflation process and furthermore protects the fabric layer 2*a*, 3*a* against the possibly detrimental influence of ultraviolet radiation.

The fabric layer 2*a*, 3*a* can also serve as a carrier layer for a special layer or coating, e.g. an electrically conductive layer for a microwave reflector. With respect to the curvature of the antenna reflector 2, the electrically conductive layer 2*c* would be located at the outside of the plastic foil 2*b* so that it could also perform a thermal control function by providing a temperature increase and uniform temperature distribution during the setting or polymerizing process. Furthermore, the mutual radiation exchange between the antenna reflector 2 and the radome 3 contributes to an even temperature distribution over the entire surface of the parabolic reflector antenna 1, thus enhancing dimensional stability. In this case, it is of particular advantage for the inside of the reflector antenna 1 to have high emissivity. The previously mentioned electrically conductive layer 2*c*, which may be a metallic layer, provides a valuable heat shield, thus further improving temperature equalization.

Figure 2:
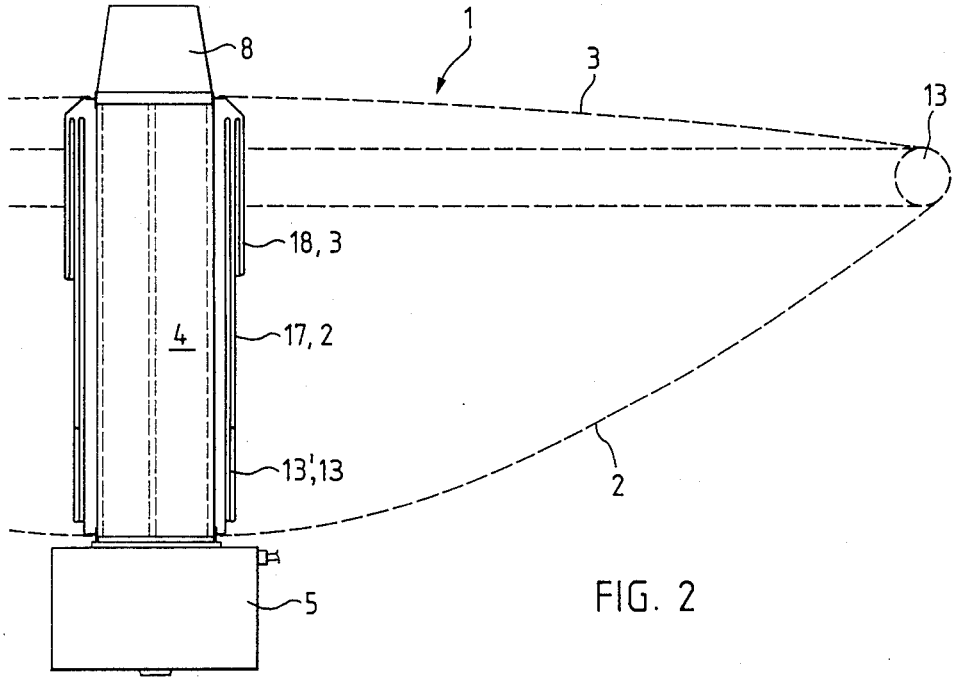
FIG. 2 shows a fragmentary schematically illustrated cross-section of the antenna according to FIG. 1, in folded condition and an indication of the outline of the unfolded reflector antenna on one side thereof.
Figure 3:
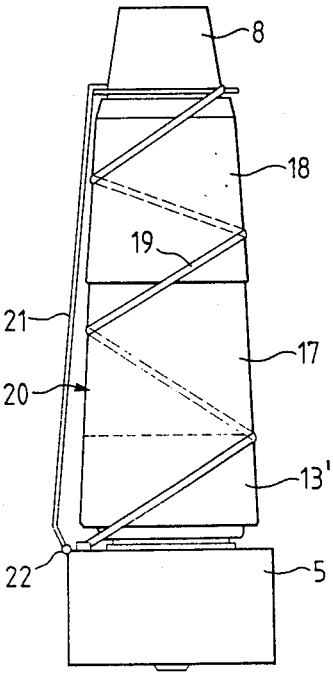
FIG. 3 shows a view of the folded antenna held together by several housing shells.

Before setting or polymerization of the synthetic resin component of the shroud body, i.e. the antenna reflector 2, the antenna radome 3 and the substantially external or peripheral rigidizing or stabilizing annulus or torus 13, the shroud body is flexible so that the antenna reflector 2, the radome 3 and the external rigidizing annulus or torus 13 are foldable to a compact package, as depicted in FIGS. 2 and 3, and thus can be placed in a space-saving configuration within the payload compartment of a carrier rocket or "space shuttle". In its packaged configuration, the antenna shroud comprising the antenna reflector 2, the antenna radome 3 and the external or peripheral rigidizing annulus or torus 13 is folded tightly around the antenna tower or feed mast 4 in a configuration of several fold layers of pleats or pleated folds 13', 17 and 18 of various lengths. The longer pleats 17 of the antenna reflector 2 extend over nearly the total length of the tower section from the interface socket component or member 5 to the feed head 8. The pleats 18 comprising part of the antenna radome 3 are shorter and are placed within the upper area, while the pleats 13' of the rigidizing peripheral annulus or torus 13 are placed adjoining the lower portion of the tower section.

FIG. 3 shows a ribbon or strap 19 which is wound helically around the fold layer of pleats or pleated folds 13', 17 and 18, thus holding them together in the form of a shroud package 20. The disengagement of the ribbon or strap 19 for unfolding or deploying the antenna 1 upon reaching orbit can be accomplished by known means which are not particularly illustrated here, e.g., mechanically or by local application of heat. In addition, the shroud package 20 is encapsulated by several pre-formed housing shells 21 arranged around the circumference and attached by means of joints or hinges 22 at the periphery of the interface socket component or member 5, permitting unfolding deployment analogous to the blossoming of a flower.

Figure 5:
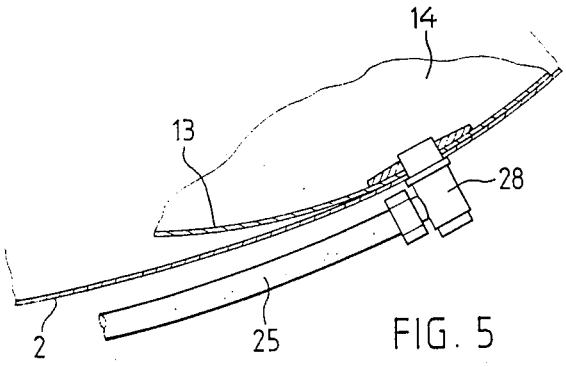
FIG. 5 shows a detail of the antenna reflector and the rigidizing member, such as a torus including its gas line or conduit connection.

The gaseous agent or medium for providing inflating pressure to the reflector antenna 1 is supplied to the antenna cavity or void 15 and to the tubular external or peripheral rigidizing annulus or torus 13 by means of the supply hoses or conduits 24 and 25, whereby the supply hose or conduit 24 which supplies the antenna cavity or void 15 terminates, as depicted in FIG. 4, in a cylindrical protrusion 27 from the fastening ring 9. The further supply hose or conduit 25 leads, as depicted in FIG. 5, from the fastening ring 9 along the outside of the antenna reflector 2 and terminates in an angle fixture or angles fitting 28 which feeds into the rigidizing peripheral annulus or torus 13. Due to the vacuum prevalent in outer space, i.e. in regions substantially beyond the atmosphere, the requisite internal pressure is relatively low; it is on the order of magnitude of 0.4 $kp/m^2$. The pressure is regulated by conventional valves within the supply lines or conduits and thus not particularly illustrated here. Conventional pressure cylinders with sufficient contents for maintaining the gas pressure during the relatively short time required for setting or polymerization of the impregnating resin are arranged in a suitable location within the space vehicle, whose conventional carrier arm is attached to the interface socket component or member 5. During the time required for the setting or polymerization process, the parabolic reflector antenna 1 is preferably oriented toward the sun in order to provide uniform heating of the antenna surface. Setting or polymerization takes place rapidly and can be further accelerated by the catalyzor gas. As setting or polymerization resins, epoxide resins are suitable. One example of a suitable epoxide resin is a modified cycloaliphatic epoxide resin which is commercially available from the well-know Swiss firm, Ciby Geigy Limited, of Basel, Switzerland, under their trademark "ARALDITE LT 580".

Alternatively or supplementarily, the radiant solar energy of the sun can be employed for causing the setting component to set. In this case, it is particularly important that the reflector antenna be oriented toward the sun immediately after deployment and until the setting component has set. It will be understood that the setting component is one which rigidifies under the influence of solar radiation, for instance, polymerizes. This embodiment of the present invention is particularly advantageous in that it permits omission of a catalyzor gas or fluid in the gaseous agent used for inflation.

Figure 6:
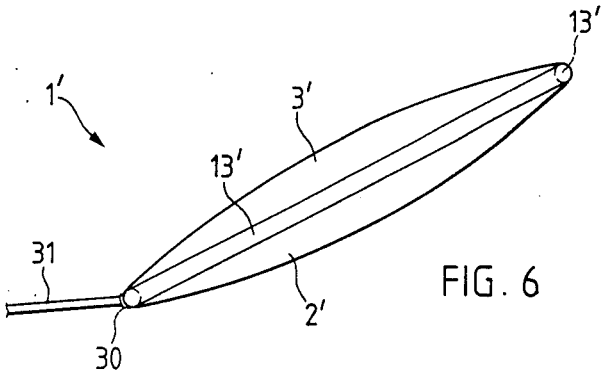
FIG. 6 shows a front view of a parabolic offset antenna constituting a second embodiment of reflector antenna.
Figure 7:
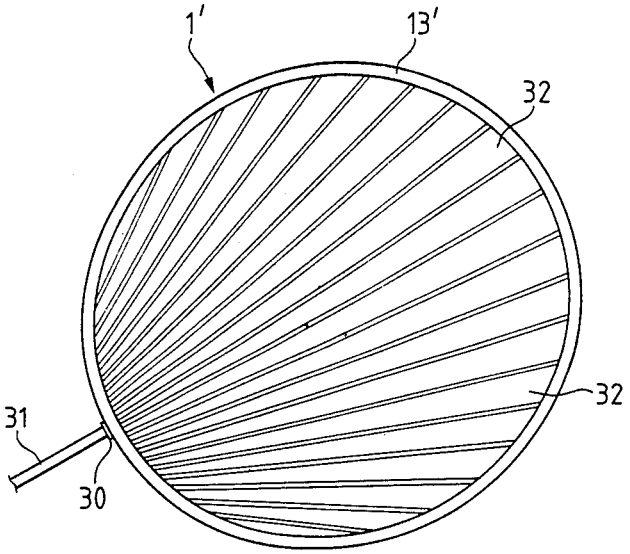
FIG. 7 shows the top view of the reflector antenna depicted according to FIG. 6.

An offset parabolic reflector antenna 1' depicted in FIGS. 6 and 7 is constructed according to the invention by inflating a structure comprising an antenna reflector 2', an antenna radome 3' and a rigidizing torus or mounting ring 13' forming an antenna cavity or void 15. An antenna arm 31 is arranged at a location 30 of the the rigidizing annulus or torus or mounting ring 13'. FIG. 7 depicts a construction of the antenna shroud comprising a plurality of pre-cut fabric strips 32, placed in mutual juxtaposition and bonded together so that the pre-cut shapes determine the shape of the offset parabolic reflector antenna 1'.

The thickness of the laminate used for the shroud body lies within the order of magnitude of 0.1 mm, with correspondingly low thickness of the fabric layer. The overall dimension of an antenna 1 or 1' according to the present invention can be varied within a wide range. A centrally fed reflector antenna 1, for instance, can be constructed with a diameter of approximately on the order of 22 meters and a height of the antenna tower or feed mast 4 on the order of six meters. An offset parabolic reflector antenna 1' can be constructed with a diameter of approximately 12 meters. It is understood that for very large diameters, it may be advantageous to use a telescopic antenna tower or feed mast.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of fabricating a reflector antenna, especially a parabolic reflector antenna comprising a deployable superficial laminate structure, and comprising an antenna reflector, an antenna radome and a stabilizing torus all inflatable to a shroud body, comprising the steps of:

employing for at least the antenna reflector and the antenna radome a shroud material treated with a setting component which is unsettable prior to inflation to form the shroud body; and inflating and thereby forming said shroud body and in conjunction therewith allowing said setting component to set and form a rigid surface configuration.

2. The method as defined in claim 1, wherein:

at least during said step of inflating said shroud body, allowing said setting component to set.

3. The method as defined in claim 1, wherein:

subsequent to said step of inflating said shroud body, allowing said setting component to set.

4. The method as defined in claim 1 and wherein:

said step of inflating and thereby forming said shroud body entails employing a gaseous agent for inflating; and said gaseous agent comprising a catalyzor gas for setting the setting component.

5. The method as defined in claim 1, wherein:

said step of allowing said setting component to set entails maintaining the reflector antenna oriented toward the sun during setting of said setting component.

6. A reflector antenna having an antenna reflector united with an antenna radome to a hollow body and stabilized by a substantially tubular stabilizing torus, wherein:

the antenna reflector, the antenna radome and the substantially tubular stabilizing torus define antenna components;

said antenna components comprising a superficial laminate structure rendered rigid by a setting process;

the antenna reflector and the antenna radome defining a subset of said antenna components;

supply means for connection to a source of a pressurized gaseous agent and for inflating said subset of antenna components to form an internal void;

further supply means for connection to said source of pressurized gaseous agent and for inflating the substantially tubular stabilizing torus;

said supply means and said further supply means allowing, by means of said pressurized gaseous agent, inflation of said internal void and said substantially tubular stabilizing torus and formation of a desired reflector antenna configuration; and said desired reflector antenna configuration being stabilized and rendered independent of the presence of said pressurized gaseous agent by means of said setting process which renders rigid said superficial laminate structure in conjunction with said inflation.

7. The reflector antenna as defined in claim 6, wherein:

said superficial laminate structure comprises a resin-impregnated textile laminate layer;

said superficial laminate structure having a curvature;

said curvature having an outer side;

a hermtric synthetic foil being laminated to said outer side of said curvature;

a portion of said hermetic synthetic foil being associated with said antenna reflector;

said portion having an outer side; and an electrically conductive material being coated on said outer side of said portion.

8. The reflector antenna as defined in claim 7, and wherein the reflector antenna is centrally fed, further including:

an antenna feed mast structure; and the antenna reflector and the antenna radome being attached to said antenna fed mast structure.

9. The reflector antenna as defined in claim 7 and wherein the reflector antenna is executed as an offset-antenna, further including:

an antenna arm; and said substantially tubular stabilizing torus comprising a mounting location for said antenna arm.

10. An antenna package for deploying a reflector antenna, comprising:

an antenna reflector;

an antenna radome;

said antenna reflector being united with said antenna radome for forming a hollow body;

a substantially tubular stabilizing torus for stabilizing said hollow body;

the antenna reflector, the antenna radome and the substantially tubular stabilizing torus defining antenna components;

said antenna components define an antenna shroud;

said antenna package containing said antenna shroud in the form of flexible thin-walled superficial structures folded together in a plurality of fold layers; and each one of said flexible thin-walled superficial structures comprising at least a textile laminate layer impregnated with settable synthetic material which is unsettable in the folded state of said flexible thin-walled superficial structure.

11. The antenna package as defined in claim 10, further including;

a plurality of housing shells;

an antenna feed mast enclosed by said antenna shroud and having a socket component;

said socket component having a plurality of hinged joints for outwardly pivotably mounting said plurality of housing shells; and the antenna package being packed as a tower and surrounded by said plurality of housing shells.

12. A method of fabricating an inflatable reflector antenna for deployment in outer space, comprising the steps of:

fabricating an antenna reflector, an antenna radome and a stabilizing annulus from a textile laminate;

said step of fabricating said antenna reflector, said antenna radome and said stabilizing annulus entailing employing as said textile laminate for said antenna reflector, said antenna radome and said stabilizing annulus a textile laminate impregnated with a setting component;

said step of fabricating said antenna reflector, said antenna radome and said stabilizing annulus entailing employing as said textile laminate for said antenna radome a textile laminate transparent to at least a portion of the electromagnetic spectrum of radiant energy;

said step of fabricating said antenna reflector, said antenna radome and said stabilizing annulus entailing applying to an outer side of said antenna reflector a material layer reflective of at least said portion of the electromagnetic spectrum of radiant energy;

said step of fabricating said antenna reflector, said antenna radome and said stabilizing annulus entailing fabricating said antenna reflector such that said antenna reflector defines a focal point;

assembling said antenna reflector, said antenna radome and said stabilizing annulus to form an inflatable envelope defining the reflector antenna and an internal void thereof;

mounting an antenna feed mast conjointly with said inflatable envelope to an interface socket of said antenna feed mast such that a feed head of said antenna feed mast is at said focal point of said antenna reflector;

providing said internal void and said stabilizing annulus with conduit means for introducing a pressurized gaseous agent; and wrapping said inflatable envelope around said antenna feed mast in a series of folded pleats to form a compact package ready for deployment in outer space by inflation with said pressurized gaseous agent and in conjunction therewith setting said setting component to form a rigid antenna structure.

13. A method of deploying a reflector antenna in outer space, comprising the steps of:

transporting beyond the atmosphere an antenna package comprising an antenna feed mast and an inflatable envelope made of a textile laminate and wrapped around said antenna feed mast in a series of folded pleats ready for deployment;

said inflatable envelope comprising an antenna reflector, an antenna radome and a stabilizing annulus;

said textile laminate being impregnated with a setting component which is unsettable in the antenna package;

inflating said inflatable envelope to impart thereto a desired spatial configuration of the reflector antenna and conjointly therewith inflating said stabilizing annulus of said inflatable envelope for stabilizing said desired spatial configuration; and in conjunction with said inflating step, setting said setting component.

14. The method as defined in claim 13, wherein:

said step of inflating said inflatable envelope entails employing a pressurized gaseous agent comprising a catalyzing agent for enhancing said step of setting said setting component.

15. A reflector antenna for deployment in outer space, comprising:

an antenna feed mast having a first end provided with an interface socket for attachment to a transport vehicle and a second end remote from said first end and provided with a feed head for the reflector antenna;

an antenna reflector, an antenna radome and a stabilizing annulus conjointly defining an inflatable envelope;

said inflatable envelope having an initial folded state in which said inflatable envelope is wrapped around said antenna feed mast to form a compact antenna package for transport into outer space;

said inflatable envelope having a terminal deployed state in which said inflatable envelope is inflated to form a desired spatial configuration of the reflector antenna defining a focal point of said antenna reflector and in which said feed head is at said focal point;

at least said antenna reflector and said antenna radome comprising a textile laminate impregnated with a setting component;

said antenna reflector being coated on at least one side with a material reflective of at least a portion of the electromagnetic spectrum of radiant energy;

said antenna radome comprising a textile laminate transparent to at least said portion of the electromagnetic spectrum;

said inflatable envelope defining a first internal void and said stabilizing annulus defining a second internal void which is separate from said first void; and flexible conduit means operatively connecting said first and second internal voids with said interface socket for introducing a pressurized gaseous agent from the transport vehicle into said first and second internal voids for inflating said inflatable envelope into said terminal deployed state and in conjunction therewith setting said setting component to rigidify said desired spatial configuration of the reflector antenna.

16. The reflector antenna as defined in claim 15, wherein:

said setting component comprises a setting resin.

17. The reflector antenna as defined in claim 15, wherein:

said setting component comprises a setting component capable of setting under the influence of solar radiation.

18. The reflector antenna as defined in claim 15, wherein:

said setting component comprises a setting component capable of setting under the influence of a catalyzing gas.

* * * * *